US010458034B2

(12) United States Patent
Murakami et al.

(10) Patent No.: US 10,458,034 B2
(45) Date of Patent: Oct. 29, 2019

(54) ANODIZING TREATMENT METHOD AND STRUCTURE OF INTERNAL COMBUSTION ENGINE

(71) Applicant: SUZUKI MOTOR CORPORATION, Shizuoka-ken (JP)

(72) Inventors: Haruhiko Murakami, Shizuoka-ken (JP); Masahiro Fujita, Shizuoka-ken (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 551 days.

(21) Appl. No.: 14/776,472

(22) PCT Filed: Mar. 26, 2015

(86) PCT No.: PCT/JP2015/059367
§ 371 (c)(1),
(2) Date: Sep. 14, 2015

(87) PCT Pub. No.: WO2015/147164
PCT Pub. Date: Oct. 1, 2015

(65) Prior Publication Data

US 2016/0138179 A1 May 19, 2016

(30) Foreign Application Priority Data

Mar. 27, 2014 (JP) ..... 2014-065955
Mar. 3, 2015 (JP) ..... 2015-041335

(51) Int. Cl.
*F02F 3/14* (2006.01)
*F02F 1/18* (2006.01)
(Continued)

(52) U.S. Cl.
CPC ..... *C25D 11/12* (2013.01); *C25D 11/024* (2013.01); *C25D 11/06* (2013.01); *C25D 11/246* (2013.01);
(Continued)

(58) Field of Classification Search
CPC ..... C25D 11/02–34; F02B 77/02; F01L 3/04; F02F 3/12–14
(Continued)

(56) References Cited

U.S. PATENT DOCUMENTS 3,666,638 A * 5/1972 Harris ..... C25D 11/12 205/175
4,166,776 A 9/1979 Lefebvre et al.
(Continued)

FOREIGN PATENT DOCUMENTS

CN 1221205 A 6/1999
CN 1225501 A 8/1999
(Continued)

OTHER PUBLICATIONS

International Search Report and Written Opinion for Application No. PCT/JP2015/059364 dated Jun. 30, 2015.
(Continued)

*Primary Examiner* — Bryan D. Ripa
*Assistant Examiner* — Ho-Sung Chung
(74) *Attorney, Agent, or Firm* — Alston & Bird LLP

(57) ABSTRACT

Provided are a method for an anodizing treatment on an aluminum-based material and a structure of an internal combustion engine which are provided with both high heat insulation properties and a high corrosion resistance, a high durability and a high impact resistance, and high water-repellent and oil-repellent functions. This method comprises the steps of: forming a second anodic oxide coating 2*b* by application of AC-DC superimposition electrolysis to an
(Continued)

aluminum-based material 1; and, after the step, forming a first anodic oxide coating 2*a* by application of direct-current electrolysis to the aluminum-based material 1, wherein the second anodic oxide coating 2*b* is formed on the first anodic oxide coating 2*a*.

5 Claims, 4 Drawing Sheets

(51) Int. Cl.

| | |
|---|---|
| ***F02F 1/24*** | (2006.01) |
| ***F02F 3/00*** | (2006.01) |
| ***C25D 11/12*** | (2006.01) |
| ***C25D 11/24*** | (2006.01) |
| ***C25D 11/02*** | (2006.01) |
| ***C25D 11/06*** | (2006.01) |
| *C25D 11/04* | (2006.01) |
| *C25D 11/08* | (2006.01) |

(52) U.S. Cl.
CPC ..... *F02F 1/18* (2013.01); *F02F 1/24* (2013.01); *F02F 3/0084* (2013.01); *F02F 3/14* (2013.01); *C25D 11/04* (2013.01); *C25D 11/08* (2013.01)

(58) Field of Classification Search
USPC ..... 428/212, 312.2, 469–472.2
See application file for complete search history.

(56) References Cited

U.S. PATENT DOCUMENTS

| | | | | |
|---|---|---|---|---|
| 4,278,737 | A * | 7/1981 | Creffield | C25D 11/12 205/171 |
| 4,440,069 | A * | 4/1984 | Holtzberg | F02F 3/003 123/193.6 |
| 4,566,952 | A | 1/1986 | Sprintschnik et al. | |
| 4,606,796 | A | 8/1986 | Hanazima et al. | |
| 4,687,551 | A | 8/1987 | Fureaux et al. | |
| 5,411,607 | A | 5/1995 | Basaly et al. | |
| 5,891,269 | A | 4/1999 | Koerner et al. | |
| 5,980,722 | A | 11/1999 | Kuroda et al. | |
| 6,027,629 | A | 2/2000 | Hisamoto et al. | |
| 6,258,463 | B1 * | 7/2001 | Corridan | C22F 1/04 148/270 |
| 6,407,367 | B1 | 6/2002 | Ito et al. | |
| 2002/0153595 | A1 | 10/2002 | Tayanaka | |
| 2006/0037866 | A1 | 2/2006 | Yamamoto et al. | |
| 2008/0149897 | A1 * | 6/2008 | Burkle | C23C 18/1208 252/389.1 |
| 2008/0213618 | A1 | 9/2008 | Critchlow et al. | |
| 2009/0236228 | A1 | 9/2009 | Yamamoto et al. | |
| 2009/0298680 | A1 | 12/2009 | Huang | |
| 2010/0219079 | A1 | 9/2010 | Routkevitch et al. | |
| 2012/0039066 | A1 | 2/2012 | Hatanaka et al. | |
| 2012/0042859 | A1 * | 2/2012 | Sakai | F02F 1/00 123/668 |
| 2012/0217167 | A1 | 8/2012 | Tanaka et al. | |
| 2013/0146041 | A1 | 6/2013 | Hijii et al. | |
| 2015/0135969 | A1 | 5/2015 | Rubio et al. | |
| 2016/0068986 | A1 | 3/2016 | Murakami et al. | |
| 2016/0138179 | A1 | 5/2016 | Murakami et al. | |

FOREIGN PATENT DOCUMENTS

| | | | |
|---|---|---|---|
| CN | 101591745 | A | 12/2009 |
| CN | 102376861 | A | 3/2012 |
| CN | 102705100 | A | 10/2012 |
| DE | 27 49 227 | C3 | 5/1978 |
| DE | 197 48 926 | A1 | 5/1998 |
| EP | 0 121 880 | B1 | 10/1984 |
| JP | S56-75592 | A | 6/1981 |
| JP | S60-134198 | | 7/1985 |
| JP | H0327797 | | 12/1991 |
| JP | H0681195 | | 3/1994 |
| JP | H111795 | A | 1/1999 |
| JP | H11509579 | | 8/1999 |
| JP | 2000109996 | | 4/2000 |
| JP | 2001-158995 | A | 6/2001 |
| JP | 2002-249895 | A | 9/2002 |
| JP | 2003003296 | | 1/2003 |
| JP | 2005008948 | | 1/2005 |
| JP | 2006083467 | | 3/2006 |
| JP | 2009235539 | | 10/2009 |
| JP | 22009256778 | | 11/2009 |
| JP | 2010 077532 | | 4/2010 |
| JP | 2010249008 | | 11/2010 |
| JP | 2012046784 | | 3/2012 |
| JP | 2014173128 | | 9/2014 |
| WO | WO 2013/171408 | | 11/2013 |

OTHER PUBLICATIONS

International Search Report and Written Opinion for Application No. PCT/JP2015/059366 dated Jun. 30, 2015.
Office Action for Chinese Application No. 201580001136.7 dated Dec. 29, 2016.
Written Opinion for Application No. PCT/JP2015/059367 dated Jun. 30, 2015.
Office Action for U.S. Appl. No. 14/776,468 dated Nov. 24, 2017, 17 pages.
International Search Report for PCT/JP2015/059367, dated Jun. 23, 2015.
Office Action for German Application No. 11 2015 000 039.9 dated Feb. 7, 2017.
Extended European Search Report for corresponding European Application No. 15722916.2 dated Dec. 8, 2015, 6 pages.
International Search Report and Written Opinion for corresponding International Application No. PCT/JP2015/055400, dated May 26, 2015 with English Translation, 18 pages.
Office Action for European Application No. 15722916.2 dated Sep. 7, 2016, 3 pages.
Office Action for U.S. Appl. No. 14/442,593 dated Feb. 14, 2018.
Office Action for U.S. Appl. No. 14/442,593 dated Sep. 13, 2017.
Ono et al., *Sealing Mechanism of Anodic Porous Oxide Films Formed on Aluminum in Lithium Hydroxide Solution*, The Japan Institute of Light Metals (Sep. 2010) 1463-1468.

* cited by examiner

ANODIZING TREATMENT METHOD AND STRUCTURE OF INTERNAL COMBUSTION ENGINE

CROSS-REFERENCE TO RELATED APPLICATIONS

This application is a national stage application filed under 35 U.S.C. 371 of International Application No. PCT/JP2015/059367, filed Mar. 26, 2015, which claims priority from Japanese Patent Application No. 2014-065955, filed Mar. 27, 2014, and Japanese Patent Application No. 2015-041335, filed Mar. 3, 2015, each of which is incorporated by reference herein in its entirety.

TECHNICAL FIELD

The present invention relates to an anodizing treatment method and to a structure of an internal combustion engine, and specifically relates to a method for an anodizing treatment of aluminum or an aluminum alloy and a structure of an internal combustion engine including the same. This application claims priority from Japanese Patent Application No. 2014-065955 filed on Mar. 27, 2014, and Japanese Patent Application No. 2015-041335 filed on Mar. 3, 2015, which are incorporated herein by reference in their entirety.

BACKGROUND ART

Conventionally, as a method for improving the corrosion resistance of aluminum and aluminum alloys (hereinafter referred to as aluminum-based materials), an anodizing treatment has been employed in which a porous anodic oxide coating is formed on a surface of an aluminum-based material. In the porous layer of the anodic oxide coating, which is formed mainly by direct-current electrolysis, pores are regularly arranged in general, although this greatly depends on the electrolysis conditions. For this reason, its porosity is one of the causes of degradation of the corrosion resistance. To improve the corrosion resistance of an anodic oxide coating, a sealing treatment for filling the pores or the like is conducted after the anodizing treatment.

As such an anodizing treatment, a method has been disclosed in which a first anodized film is formed on a surface of an aluminum-based material by a first current application, and then a second anodized film is formed by a second current application with a larger quantity of electricity than the quantity of electricity in the first current application, so that the flatness and smoothness are increased (PTL 1). In addition, a method has been disclosed in which an anodic oxide coating having an increased corrosion resistance is formed by using a phosphoric acid electrolytic liquid, employing a voltage to 20 V or lower at an initial stage, and then increasing the treatment voltage up to a final voltage which is five times or more the treatment voltage at the initial stage (PTL 2).

In addition, a method has been disclosed in which an anodic oxide coating with a high porosity and a large film thickness is formed to lower the thermal conductivity and to improve the fuel-efficiency (PTL 3). A technology has been disclosed in which an anodic oxide coating provided with a bonding region where each hollow cell forming an anodic oxide coating is bonded to adjacent hollow cells and a nonbonding region where three or more adjacent hollow cells are not bonded to each other is formed by application of direct-current electrolysis, and then pores are filled by a treatment with boiling water or steam or by coating with a thin film (PTL 4). Moreover, a technology has been disclosed by which a dense anodic oxide coating is formed in the vicinity of an aluminum-based material by repeating a step of applying a positive voltage and a step of removing electric charge by using a power source having an alternating current component (PTL 5).

CITATION LIST

Patent Literature

[PTL 1] Japanese Patent Application Publication No. 2009-256778

[PTL 2] Japanese Patent Application Publication No. 2000-109996

[PTL 3] Japanese Patent Application Publication No. 2010-249008

[PTL 4] Japanese Patent Application Publication No. 2012-46784

[PTL 5] Japanese Patent Application Publication No. 2006-83467

SUMMARY OF INVENTION

In such an anodizing treatment, pores are formed regularly in a growth process of the anodic oxide coating. In particular, in an aluminum-based material containing impurity elements, such as an aluminum alloy, it is difficult for the anodic oxide coating to grow around the impurity elements, and pores tend to be formed there. When an anodic oxide coating in the vicinity of an aluminum-based material is dense, the heat insulation properties are low, because the pores are relatively scarce. In addition, when multiple cylindrical pores are present in a surface of an anodic oxide coating, it is not possible to achieve both high heat insulation properties and a high corrosion resistance simultaneously. Moreover, to obtain a desired porosity and a desired film thickness, it is necessary to conduct the anodizing treatment for a long period. Hence, the formation speed of the anodic oxide coating is low, and the formation efficiency of the coating is poor.

When such an anodic oxide coating is used for a structure of an internal combustion engine, for example, a piston or the like, the anodic oxide coating is required to have extremely high durability and impact resistance sufficient to withstand impact of combustion, and to have a water-repellent function and an oil-repellent function for preventing adhering of fuel to the structure of an internal combustion engine, for example, a head surface of a piston for an internal combustion engine and for preventing unburned materials. In addition, for applying the anodic oxide coating to a structure of a combustion chamber, it is necessary to fill the open pores after the formation of the coating. Moreover, it is necessary to improve the coating formation efficiency by forming an anodic oxide coating having a predetermined porosity and a predetermined film thickness in a short period.

In view of the above-described problems, an object of the present invention is to provide a method for an anodizing treatment for an aluminum-based material and a structure of an internal combustion engine which are provided with both high heat insulation properties and a high corrosion resistance, a high durability and a high impact resistance, high water-repellent and oil-repellent functions, and a good coating formation efficiency.

In an aspect of the present invention, a treatment method for an anodic oxide coating according to the present invention comprises the steps of: forming a second anodic oxide coating by application of AC-DC superimposition electrolysis to an aluminum-based material; and after the step, forming a first anodic oxide coating by application of direct-current electrolysis to the aluminum-based material, wherein the second anodic oxide coating is formed on the first anodic oxide coating.

In another aspect of the present invention, a structure of an internal combustion engine according to the present invention comprises at least: a first anodic oxide coating on a surface of an aluminum-based material constituting a combustion chamber in an internal combustion engine; and a second anodic oxide coating on a surface of the first anodic oxide coating, wherein the first anodic oxide coating has more pores therein than the second anodic oxide coating.

The present invention makes it possible to obtain a method for an anodizing treatment on an aluminum-based material and a structure of an internal combustion engine which are provided with both high heat insulation properties and a high corrosion resistance, a high durability and a high impact resistance, high water-repellent and oil-repellent functions, and a good coating formation efficiency.

DESCRIPTION OF EMBODIMENT

Figure 1:
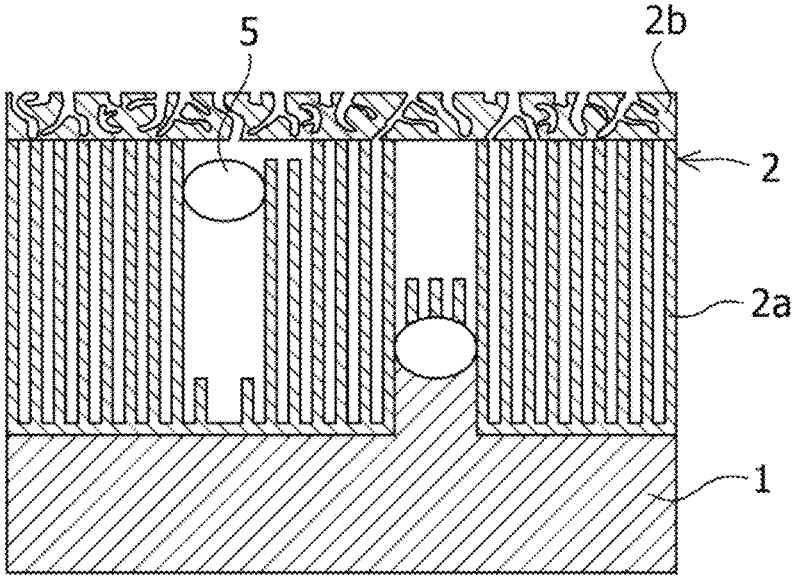
FIG. 1 is a cross-sectional view schematically showing an anodic oxide coating of an anodizing treatment method and a structure of an internal combustion engine according to the present invention.

Embodiments of Anodic Oxide Coating and Structure of Internal Combustion Engine An embodiment of an anodic oxide coating constituting a structure of an internal combustion engine according to the present invention will be described in further detail with reference to the attached drawings. FIG. 1 is a schematic cross-sectional view showing an anodic oxide coating 2 of this embodiment. As shown in FIG. 1, the anodic oxide coating 2 is provided on a surface of an aluminum-based material 1. Note that when the aluminum-based material 1 is an aluminum alloy containing silicon as an impurity and/or additive, silicon 5 is included inside the surface of the anodic oxide coating.

The aluminum-based material 1 is a workpiece to be coated with the anodic oxide coating 2. The meaning of "aluminum-based material" in this embodiment includes not only aluminum, but also aluminum alloys containing alloy components such as silicon and copper and aluminum alloys such as wrought aluminum materials, cast aluminum materials, and die-cast aluminum materials (ADC) containing such alloy components. More specifically, the aluminum alloys include AC materials such as AC4, AC8, AC8A, and AC9, ADC materials such as ADC10 to ADC14, A1000 to A7000, and the like. The aluminum-based material 1 may be an aluminum member processed into a component or the like. The aluminum-based material 1 is preferably used for a structure of an internal combustion engine, for example, a combustion chamber where the anodic oxide coating 2 is required to be high in impact resistance, durability, heat insulation properties, water repellency, oil repellency, and the like. The anodic oxide coating 2 of this embodiment can meet the requirements for the above-described performances. Note that, in this embodiment, the "heat insulation properties" required for an internal combustion engine means performances and/or functions of thermally insulating heat from a combustion portion to the outside and/or heat from the outside to the combustion portion in a combustion chamber in an internal combustion engine.

The aluminum-based material 1 may contain impurities and/or additives. The impurities and/or additives include silicon (Si), copper (Cu), magnesium (Mg), zinc (Zn), iron (Fe), tin (Sn), manganese (Mn), nickel (Ni), titanium (Ti), and the like. These impurities and/or additives are preferably 8% by mass to 30% by mass relative to the aluminum-based material. Since the impurities and/or additives also lead to the formation of pores of the anodic oxide coating 2, the impurities and/or additives can contribute to the heat insulation properties of the anodic oxide coating 2. Note that, in this embodiment, the silicon 5 is shown as an example of the impurities. The silicon 5 is added to enhance the castability, the wear resistance, and the like of the aluminum-based material 1.

The anodic oxide coating 2 includes a first anodic oxide coating 2*a* and a second anodic oxide coating 2*b*. The anodic oxide coating 2 has a two-layer structure of the first anodic oxide coating 2*a* and the second anodic oxide coating 2*b*, and this two-layer structure imparts multiple functions such as heat insulation properties, corrosion resistance, durability, impact resistance, water repellency, and oil repellency to the aluminum-based material 1.

The first anodic oxide coating 2*a* is a porous coating provided on the surface of the aluminum-based material 1 by application of direct-current electrolysis. The first anodic oxide coating 2*a* has a regular orientation. For this reason, the first anodic oxide coating 2*a* has more pores (first pores) than the second anodic oxide coating 2*b*. In other words, the first anodic oxide coating 2*a* is sparse, and the second anodic oxide coating 2*b* is dense in terms of the size, number, and/or distribution of the pores. In addition, the first pores are formed also because of the presence of the silicon 5 and the like.

The air in the many first pores present on the surface of and inside the first anodic oxide coating 2*a* has a low thermal conductivity. Hence, the first anodic oxide coating 2*a* has higher heat insulation properties than the second anodic oxide coating 2*b*. In addition, the first anodic oxide coating 2*a* has corrosion resistance, and can prevent a substance which may cause corrosion from reaching the aluminum-based material 1. Accordingly, the first anodic oxide coating 2*a* imparts high heat insulation properties and a high corrosion resistance to the aluminum-based material 1, and, in cooperation with the second anodic oxide coating 2*b*, imparts a highly-reliable heat insulation performance to the aluminum-based material 1.

The second anodic oxide coating 2*b* is a porous coating provided on the surface of the aluminum-based material 1 by application of AC-DC superimposition electrolysis, and has multiple pores (second pores). In addition, the second pores are formed also because of the presence of the silicon 5 and the like. The second anodic oxide coating 2*b* has a denseness attributable to the random orientation. Specifically, the second anodic oxide coating 2*b* is an anodic oxide coating which has grown in random directions with respect to the surface of the aluminum-based material 1, and which does not have orientation. For this reason, the second anodic oxide coating 2*b* can prevent a substance which may cause corrosion, for example, water, from reaching the aluminum-based material 1 to a greater degree, and provides a higher corrosion resistance than the first anodic oxide coating 2*a*. More specifically, since the second pores are oriented in random directions, it is also possible to prevent water which may cause corrosion from entering many pores at once under a pressure in a direction. Note that the "denseness" means that the size and the number (distribution) of the pores are smaller than those of other anodic oxide coatings.

The second anodic oxide coating 2*b* can improve the heat insulation properties of the first anodic oxide coating 2*a* by covering the pores of the first anodic oxide coating 2*a* as a lid for the first anodic oxide coating 2*a*, without filling the pores. In addition, the second anodic oxide coating 2*b* can prevent a substance which may cause corrosion from reaching the aluminum-based material 1. That is, the second anodic oxide coating 2*b* imparts a high corrosion resistance to the aluminum-based material 1, and improves the heat insulation properties of the second anodic oxide film 2*b*. In addition, the second anodic oxide coating 2*b* has not only a high corrosion resistance, but also a high density, a high hardness, and a low surface roughness. A low surface roughness means that the surface of the second anodic oxide coating 2*b* is flat and smooth. For this reason, when the anodic oxide coating 2 is used for a structure of an internal combustion engine, for example, a piston for an internal combustion engine, the second anodic oxide coating 2*b* can impart durability and impact resistance sufficient to withstand impact of combustion to the anodic oxide coating 2, and prevent adhering of fuel and adhering of unburned materials.

The first anodic oxide coating 2*a* and the second anodic oxide coating 2*b* are preferably formed in anodizing treatment baths containing the same components for a liquid agent, and are more preferably formed under substantially the same temperature conditions. In this case, the components of the first anodic oxide coating 2*a* and the components of the second anodic oxide coating 2*b* are substantially the same. For this reason, a connecting portion (boundary portion) between the first anodic oxide coating 2*a* and the second anodic oxide coating 2*b* can be formed continuously. This makes it possible to obtain an integrated and firm connecting portion between the first anodic oxide coating 2*a* and the second anodic oxide coating 2*b*. Consequently, the first pores of the first anodic oxide coating 2*a* are prevented from being filled by a sealing treatment, described later, so that degradation of heat insulation properties can be prevented. In addition, it is possible to prevent occurrence of adhesion failure, peeling, or the like between the anodic oxide coatings. Furthermore, the first anodic oxide coating 2*a* and the second anodic oxide coating 2*b* impart a highly reliable durability performance and a highly reliable impact resistance performance to the aluminum-based material 1.

As an anodizing treatment liquid (liquid agent) for forming each of the first anodic oxide coating 2*a* and the second anodic oxide coating 2*b*, any one of acidic baths of sulfuric acid ($H_2SO_4$), oxalic acid ($H_2C_2O_4$), phosphoric acid ($H_3PO_4$), chromic acid ($H_2CrO_4$), and the like, or basic baths of sodium hydroxide (NaOH), sodium phosphate ($Na_3PO_4$), sodium fluoride (NaF), and the like may be used. The aluminum-based material 1 on the surface of which the anodic oxide coating 2 is formed is not limited to a case in which a specific anodizing bath is used, but sulfuric acid is preferable from a practical viewpoint. When a phosphoric acid bath is used, the size and the number (distribution) of the pores of the first anodic oxide coating 2*a* can be increased depending on the electrolysis conditions.

The film thickness of the anodic oxide coating 2 can be 50 μm to 500 μm. A lower limit of the film thickness is preferably 100 μm. If the film thickness is 100 μm or more, it is possible to improve the fuel-efficiency, and also improve the slidability, the durability, and the heat insulation properties of the anodic oxide coating 2. Meanwhile, an upper limit of the film thickness is preferably 300 μm, and further preferably 200 μm. Within this range, the anodic oxide coating 2 can be formed in a relatively short period.

The film thickness of the first anodic oxide coating 2*a* may be any, as long as the film thickness is greater than that of the second anodic oxide coating 2*b*. For example, the film thickness of the first anodic oxide coating 2*a* is at least 25 μm. More specifically, a lower limit of the film thickness is preferably 50 μm or more, and more preferably 100 μm or more. Within this range, the heat insulation properties of the anodic oxide coating 2 can be further improved. Meanwhile, an upper limit of the film thickness is preferably 400 μm or less, more preferably 300 μm or less, and further preferably 200 μm or less. Within these ranges, effects capable of improving the heat insulation properties and the durability are achieved.

Regarding the porosity of the first anodic oxide coating 2*a*, a lower limit of the porosity is preferably 25%, and more preferably 30%. If the porosity is 25% or higher, and more preferably 30% or higher, it is possible to improve the fuel-efficiency, and impart heat insulation properties to the anodic oxide coating 2 in cooperation with the second anodic oxide coating 2*b*. Meanwhile, an upper limit of the porosity may be a porosity with which the strength is not lowered. More specifically, an upper limit of the porosity is preferably 75%, more preferably 60%, and further preferably 50%. Within these ranges, an anodic oxide coating 2 having a high durability can be obtained, with the strength of the anodic oxide coating 2 being retained in an appropriate range. Note that the "porosity" means the volume ratio of pores in the coating.

A lower limit of the film thickness of the second anodic oxide coating 2*b* is preferably 10 μm. If the lower limit is 10 μm, a high voltage can be applied stably from the beginning to the end of the electrolysis in the formation of the first anodic oxide coating 2*a* by a direct-current electrolysis method under the second anodic oxide coating 2*b*, without causing burning of the coating. Moreover, the formation speed of the coating can be increased, and the formation efficiency of the coating can be improved. Meanwhile, an upper limit of the film thickness is preferably 200 μm, more preferably 150 μm, and further preferably 100 μm. Within these ranges, such effects that the corrosion resistance, the durability, and the impact resistance can be improved and that the adhering of substances can be prevented are achieved.

The anodic oxide coating of this embodiment can constitute a structure of an internal combustion engine, for example, a combustion chamber in an internal combustion engine. The combustion chamber in an internal combustion engine is, for example, a portion surrounded by a piston, a cylinder, and a cylinder head. More specifically, the combustion chamber in an internal combustion engine is a portion surrounded by an upper surface of a piston, a cylinder, and a bottom surface of a cylinder head. When the anodic oxide coating 2 of this embodiment is applied to, among these components, each of the piston and the cylinder head which are components for which aluminum-based materials are used, the durability and the heat insulation properties can be improved. Such a cylinder can be formed by casting a cylinder sleeve made of cast iron in an engine block. Alternatively, for example, in a case of a sleeveless internal combustion engine not using a cylinder sleeve, a bore inner surface of the cylinder block serves as the cylinder. Accordingly, if the anodic oxide coating 2 of this embodiment is used on the bore inner surface, the durability, the heat insulation properties, the slidability, and the like can be improved. When the anodic oxide coating 2 is used on the bore inner surface, a plated coating or a thermal-sprayed coating may be also formed.

For example, when the anodic oxide coating 2 is used for a combustion chamber in an internal combustion engine, for example, a piston for an internal combustion engine, the second anodic oxide coating 2*b* is provided on a head surface. Hence, it is possible to prevent adhering of fuel and adhering of unburned materials to the head surface. Consequently, it is possible to prevent occurrence of engine trouble due to adhering of deposits. Moreover, since the first anodic oxide coating 2*a* has a higher porosity (lower density) than the second anodic oxide coating 2*b*, the first anodic oxide coating 2*a* is a coating with a low hardness. On the other hand, the second anodic oxide coating 2*b* has a lower porosity (higher density), and hence has a higher hardness than the first anodic oxide coating 2*a*. The surface roughness is lower, i.e., the coating has a smaller heat-receiving area in a case in which the second anodic oxide coating 2*b* is present on the topmost surface than in a case in which the first anodic oxide coating 2*a* is present on the topmost surface, and the coating with a smaller heat-receiving area is advantageous to the heat insulation properties. A synergistic effect of the first anodic oxide coating 2*a* and the second anodic oxide coating 2*b* makes it possible to obtain an anodic oxide coating 2 having a high strength and highly-reliable heat insulation properties and a piston for an internal combustion engine comprising the anodic oxide coating 2.

In addition, if necessary, the anodic oxide coating 2 (the first anodic oxide coating 2*a* and the second anodic oxide coating 2*b*) can be subjected to a sealing treatment for sealing the pores of the first anodic oxide coating 2*a* with a strongly basic solution. When a sealing treatment is conducted on the first anodic oxide coating 2*a*, the second anodic oxide coating 2*b*, and/or the aluminum-based material 1 including the first anodic oxide coating 2*a* and the second anodic oxide coating 2*b*, it is possible to obtain a first anodic oxide coating and a second anodic oxide coating in which the first pores and the second pores are sealed with product (not shown) that originated from a strong-base treatment liquid. This makes it possible to further improve the corrosion resistance of the first anodic oxide coating and the second anodic oxide coating, the aluminum-based material 1. The sealing treatment is described later.

Note that the anodic oxide coating 2 after an anodic oxide coating formation step has a sufficiently high heat resistance and a sufficiently high corrosion resistance, even without performing a corrosion inhibition treatment such as the sealing treatment. For this reason, although treatments such as the above-described sealing treatment, a washing treatment, a repairing treatment, and a coating treatment can be conducted, the sealing treatment can be omitted. Whether or not it is necessary to carry out the sealing treatment by conducting a sealing treatment on the anodic oxide coating 2 can be determined, as appropriate, depending on a required function. In this case, the amount of labor can be reduced, and the production costs can be reduced.

[Embodiment of Treatment Method for Anodic Oxide Coating]

By describing a mode of operation of the anodic oxide coating having the above-described configuration, one embodiment of a treatment method for an anodic oxide coating will be described in further detail with reference to the attached drawings.

Figure 2:
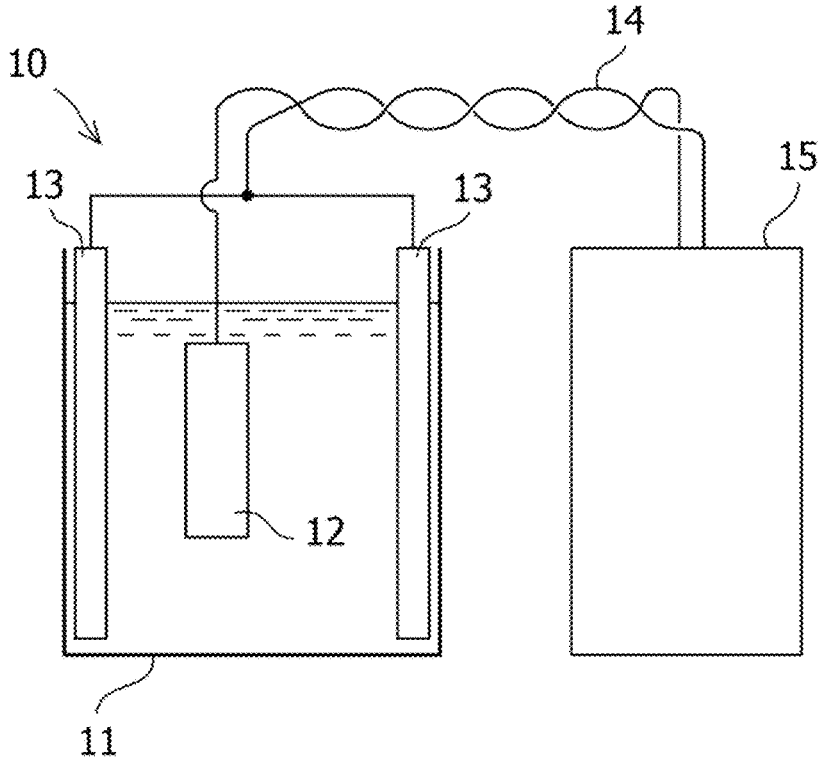
FIG. 2 is a structural view schematically showing an anodizing treatment apparatus used in a treatment method for an anodic oxide coating relating to the anodizing treatment method and the structure of an internal combustion engine according to the present invention.

FIG. 2 is a structural view showing an outline of an anodizing treatment apparatus 10 used in a treatment method for an anodic oxide coating 2. The anodizing treatment apparatus 10 includes an electrolytic tank 11 which houses an anodizing treatment liquid, an anode 12 and a pair of cathodes 13 immersed in the anodizing treatment liquid, a lead wire 14, and a power source 15. Each of the pair of cathodes 13 is arranged to face the other in the electrolytic tank 11, with the anode 12 placed at the center between the cathodes 13. The anode 12 and the pair of cathodes 13 are connected to the power source 15 through the lead wire 14. In addition, the anodizing treatment apparatus 10 is configured to apply direct-current electrolysis and AC-DC superimposition electrolysis by the power source 15 through the anode 12, the pair of cathodes 13, and the lead wire 14.

The anodizing treatment apparatus 10 preferably includes a stirring apparatus (not shown) capable of stirring the anodizing treatment liquid. This makes it possible to prevent local burning due to generated bubbles and the like, and to assist the anodic oxide coating 2 to uniformly grow. In addition, each of the pair of cathodes 13 is preferably configured such that the surface area of the cathode 13 immersed in the anodizing treatment liquid can be 20 times or more greater than the surface area of the aluminum-based material 1 serving as the anode 12. This makes it possible to obtain a uniform anodic oxide coating 2.

In an anodic oxide coating formation step, the aluminum-based material 1 and titanium (Ti) are respectively placed as the anode 12 and as the cathodes 13 in the anodizing treatment liquid. By electrolyzing the anodizing treatment liquid, the anodic oxide coating 2 containing aluminum oxide as a main component is formed in the vicinity of the surface of the aluminum-based material 1. The anodic oxide coating 2 imparts functions such as corrosion resistance and wear resistance to the aluminum-based material 1. Note that the material of the cathodes 13 may be any material, as long as the material can function as the cathodes 13, and besides titanium, a carbon plate, an aluminum plate, a stainless steel plate, and the like can be used.

In a first anodic oxide coating formation step, the second anodic oxide coating 2*b* is formed by application of AC-DC superimposition electrolysis to the aluminum-based material 1. In other words, the first anodic oxide coating formation step is carried out by an AC-DC superimposition electrolysis method in which an alternating current is superimposed on a direct current (hereinafter, this method is also referred to as an AC-DC superimposition electrolysis method). In this step, the second anodic oxide coating 2*b* is formed in the vicinity of the surface mainly including an upper portion of the surface of the aluminum-based material 1. The second anodic oxide coating 2*b* is a porous coating provided in the vicinity of the surface of the aluminum-based material 1 by application of AC-DC superimposition electrolysis, and has multiple pores (second pores). The second anodic oxide coating 2*b* is dense because of random orientation. Hence, the corrosion resistance is high because it is possible to make a substance that may cause corrosion less likely to penetrate to the aluminum-based material 1. In addition, the hardness is high, and the surface roughness is low (the surface is flat and smooth). Note that the "denseness" means that the size and the number (distribution) of the pores are smaller than those of other anodic oxide coatings.

The second anodic oxide coating 2*b* formed in the first anodic oxide coating formation step covers the pores of the first anodic oxide coating 2*a* as a lid for the first anodic oxide coating 2*a*, without filling the pores. This makes it possible to maintain or improve the heat insulation properties of the first anodic oxide coating 2*a*. In addition, the second anodic oxide coating 2*b* can prevent a substance that may cause corrosion from reaching the aluminum-based material 1. That is, the second anodic oxide coating 2*b* imparts a high corrosion resistance to the aluminum-based material 1, and improves the heat insulation properties of the anodic oxide coating 2.

In a second anodic oxide coating formation step after the first anodic oxide coating formation step, the first anodic oxide coating 2*a* is formed by application of direct-current electrolysis to the aluminum material 1 having the second anodic oxide coating 2*b* (hereinafter, this method is also referred to as a direct-current electrolysis method). In this step, the second anodic oxide coating 2*b* is formed in the vicinity of the surface of the aluminum-based material 1. In other words, the first anodic oxide coating 2*a* is formed between the second anodic oxide coating 2*b* and the aluminum-based material 1. Because of its orientation, the first anodic oxide coating 2*a* has more pores (first pores) than the second anodic oxide coating 2*b*. In other words, the first anodic oxide coating 2*a* is sparse, and the second anodic oxide coating 2*b* is dense in terms of the size, number, and/or distribution of the pores. In addition, the first pores are formed also because of the presence of the silicon 5 and the like.

Many first pores are present on the surface of and inside the first anodic oxide coating 2*a* formed in the second anodic oxide coating formation step. Since the air in the first pores has low thermal conductivity, the first anodic oxide coating 2*a* has higher heat insulation properties than the second anodic oxide coating 2*b*. In addition, the first anodic oxide coating 2*a* also has corrosion resistance attributable to aluminum oxide, and can prevent a substance which may cause corrosion from reaching the aluminum-based material 1. The first anodic oxide coating 2*a* can impart corrosion resistance to the aluminum-based material 1, and can impart highly-reliable heat insulation properties to the aluminum-based material 1 by a synergistic effect with the second anodic oxide coating 2*b*.

The first anodic oxide coating formation step and the second anodic oxide coating formation step can be carried out in different anodizing treatment liquids or at different temperatures depending on the purpose, but are preferably carried out in anodizing treatment liquids containing the same liquid agent components, and more preferably carried out further at the same temperature. In this case, the components of the first anodic oxide coating 2*a* and the components of the second anodic oxide coating 2*b* are substantially the same. Hence, the first anodic oxide coating 2*a* and the second anodic oxide coating 2*b* can be formed continuously. This makes it possible to obtain an integrated and firm connecting portion between the anodic oxide coating 2*a* formed by the direct-current electrolysis and the anodic oxide coating 2*b* formed by the AC-DC superimposition electrolysis. Consequently, this eliminates the possibility that the pores of the anodic oxide coating formed by the direct-current electrolysis may be filled in a sealing treatment (described later), and makes it possible to prevent degradation of heat insulation properties. In addition, it is possible to prevent occurrence of adhesion failure, peeling, or the like between the anodic oxide coatings. This makes it possible to obtain a high durability.

As the anodizing treatment liquid, any one of acidic baths of sulfuric acid ($H_2SO_4$), oxalic acid ($H_2C_2O_4$), phosphoric acid ($H_3PO_4$), chromic acid ($H_2CrO_4$), and the like, or basic baths of sodium hydroxide (NaOH), sodium phosphate ($Na_3PO_4$), sodium fluoride (NaF), and the like may be used. The aluminum-based material 1 on the surface of which the anodic oxide coating 2 to be subjected to a sealing treatment described later is formed is not limited to a case in which a specific anodizing bath is used, but an acidic bath is preferable, and a sulfuric acid is more preferable, from a practical viewpoint.

The temperature of the anodizing treatment liquid may be any temperature, as long as the first anodic oxide coating 2*a* and the second anodic oxide coating 2*b* can be formed at the temperature. More specifically, the temperature of the anodizing treatment liquid is preferably 5.0° C. to 30° C., and more preferably is 10° C. to 20° C. If the temperature is within the above-described range, for example, both the first anodic oxide coating 2*a* and the second anodic oxide coating 2*b* having predetermined hardness are capable of being formed by an anodizing treatment, while eliminating the need for film formation involving cooling to about 0° C., such as the hard coating method. In addition, the continuity of the connecting portion between the first anodic oxide coating 2*a* and the second anodic oxide coating 2*b* is improved, so that an integrated and firm anodic oxide coating 2 can be obtained.

The frequency of the AC-DC current in the first anodic oxide coating formation step is preferably 5 kHz to 20 kHz, and more preferably 10 kHz to 20 kHz. In addition, the voltage of the positive electrode is preferably 12 V to 70 V, and the voltage of the negative electrode is preferably −10 V to 0 V. Within the above-described ranges, it is possible to improve the uniformity of the thickness of the coating and obtain the second anodic oxide coating 2*b* which has corrosion resistance, water repellency, and oil repellency with low variations among portions. Note that the current application time is not particularly limited, and the application can be carried out in a practical amount of time.

Regarding the concentration of an acid component in the anode acid treatment liquid used in the first anodic oxide coating formation step, a lower limit of the concentration is preferably 100 g/L. Meanwhile, an upper limit of the concentration may be any, as long as burning of the coating does not occur. More specifically, an upper limit of the concentration is preferably 600 g/L, and more preferably 500 g/L. Within this range, the dissolution speed of the aluminum-based material 1 can be controlled not to exceed the formation speed of the coating. Hence, it is possible to reduce the probability that color change due to burning of the coating may occur on the surface of the second anodic oxide coating 2*b*.

Regarding the current density of the direct-current electrolysis in the second anodic oxide coating formation step, a lower limit of the current density is preferably 1 A/dm$^2$ or higher, more preferably 4 A/dm$^2$ or higher, further preferably 8 A/dm$^2$ or higher, and most preferably 10 A/dm$^2$ or higher. Within this range, the porosity of the coating can be improved, and by increasing the formation speed of the coating, the formation efficiency of the coating can be improved. Meanwhile, an upper limit of the current density may be any, as long as burning of the coating does not occur. More specifically, the upper limit is preferably 80 A/dm$^2$ or lower, more preferably 50 A/dm$^2$ or lower, and further preferably 40 A/dm$^2$ or lower. Within this range, it is possible to reduce the probability that burning of the coating may occur on the surface of the anodic oxide coating, while improving the formation efficiency of the coating.

Regarding the concentration of an acid component in the anodizing treatment liquid used in the second anodic oxide coating formation step, a lower limit of the concentration is preferably 10 g/L. The lower the concentration of the acid component is, the larger the pores of the coating can be. Meanwhile, an upper limit of the concentration is any, as long as burning of the coating does not occur. More specifically, the upper limit is preferably 100 g/L, more preferably 50 g/L, and further preferably 25 g/L. Within these ranges, it is possible to form an anodic oxide coating with a uniform film thickness without causing irregularities or color change due to the burning of the coating on the surface of the formed anodic oxide coating, and further improve the formation efficiency and the porosity of the uniform coating. In addition, when the concentration of an acid component is 100 g/L or higher, there is a possibility that the voltage value of the voltage applied to the surface of the aluminum may be lowered to about 25 V, so that the formation speed of the coating decreases.

In the second anodic oxide coating formation step, a constant current density is applied. Here, the voltage applied to the surface of the aluminum on which the anodic oxide coating is being formed increases with the progress of the formation of the anodic oxide coating, because of the resistance of the aluminum oxide, which is the main component of the anodic oxide coating. Although it is therefore difficult to control the voltage to a constant value, it is preferable to keep the voltage value of the voltage applied from the start to the end of the electrolysis treatment always at 40 V or higher, because the porosity of the first anodic oxide coating 2*a* can be 25% or higher. Note, however, that since the voltage is unstable at the initial stage in which the electrolysis treatment is started, there is a possibility that the voltage may be lower than 40 V.

In a sealing treatment step, an ordinary sealing treatment can be applied. The sealing treatment may be a strongly basic sealing bath, boiling water sealing, nickel salt sealing, or the like. In the sealing treatment step in this embodiment, a sealing liquid is adhering to the surface of the anodic oxide coating 2 to cause the pores of the anodic oxide coating 2 to penetrate into the sealing liquid. The sealing liquid enters the pores of the anodic oxide coating 2, and forms a compound in the pores. In particular, the sealing liquid enters mainly the second pores of the second anodic oxide coating 2*b*, and forms the compound therein. This makes it possible to improve the heat insulation properties of the anodic oxide coating 2. The sealing treatment step is preferably conducted as follows. Specifically, a treatment liquid is applied or sprayed onto the workpiece having the anodic oxide coating 2, or the workpiece is immersed in the treatment liquid. Then, the workpiece is held in the air, then washed with water, and dried. In addition, it is preferable that the workpiece having the anodic oxide coating 2 be immersed in the treatment liquid, taken out of the treatment liquid after 0.5 minutes or more, and washed with water and dried. The sealing treatment method based on the application or spray enables a partial sealing treatment. For this reason, in a treatment on a large component, it is possible to eliminate the need for a large tank for immersing the large component in the treatment.

In the sealing treatment step, the second anodic oxide coating 2*b* serves as a lid of the first anodic oxide coating 2*a*, and covers the first pores, without filling the pores. Accordingly, the degradation of the heat insulation properties of the first anodic oxide coating 2*a* can be prevented, without sealing the many first pores in the sealing treatment. In addition, the connecting portion between the first anodic oxide coating 2*a* and the second anodic oxide coating 2*b* is formed to be integrated and firm. Hence, the sealing treatment makes it possible to improve the corrosion resistance, while preventing degradation of the heat insulation properties and decrease in the reliability of the heat insulation properties.

Note that the anodic oxide coating 2 after the anodizing treatment formation step has a sufficiently high heat resistance and a sufficiently high corrosion resistance, even without performing a corrosion inhibition treatment such as the sealing treatment. For this reason, the sealing treatment can be omitted, among post treatments including the sealing treatment, the washing treatment, the repairing treatment, the coating treatment, and the like. Whether or not it is necessary to carry out the sealing treatment by conducting a sealing treatment on the anodic oxide coating 2 can be determined, as appropriate, depending on a required function. When the sealing treatment is carried out, the corrosion resistance of the anodic oxide coating 2 can be improved. If no sealing treatment is carried out, the man-hours can be reduced, and the production costs can be reduced. Hence, a structure of an internal combustion engine can be constituted of an anodic oxide coating formed at reduced production costs.

[Problems Solved by Embodiment and Operations and Effects]

For example, in an anodic oxide coating formed by a direct-current electrolysis method, pores penetrating the anodic oxide coating from the surface of the anodic oxide coating to the vicinity of an aluminum-based material are present. For this reason, heat enters the anodic oxide coating through the pores to the vicinity of the aluminum-based material. Accordingly, heat conduction to and from the aluminum-based material occurs. Consequently, there arises a problem of low heat insulation properties. In addition, in a case in which fuel containing water, a corrosive substance, or the like is present, the anodic oxide coating cannot absorb the fuel or the substance. For this reason, the fuel or the substance passes through the pores penetrating the anodic oxide coating to the vicinity of the aluminum-based material and reaches the aluminum-based material. Consequently, there arises a problem of degradation of corrosion resistance. Meanwhile, when a dense anodic oxide coating is present in the vicinity of an aluminum-based material, pores are fewer in this dense anodic oxide coating than in an anodic oxide coating formed by direct-current electrolysis. Consequently, there arises a problem of lower heat insulation properties than those of an anodic oxide coating formed by a direct-current electrolysis method.

In particular, when an anodic oxide coating is used for a structure of an internal combustion engine, for example, a piston for an internal combustion engine (in particular, a head surface) or the like, the anodic oxide coating is required to have extremely high durability and impact resistance sufficient to withstand the repeated stress due to the explosion pressure, the injection pressure, the thermal expansion, and the thermal contraction during the combustion. However, an anodic oxide coating formed with a direct current has a low density, and hence has a low hardness. Therefore, there is a possibility that the anodic oxide coating cannot withstand use for a piston for an internal combustion engine, and it may break. Moreover, an anodic oxide coating formed with a direct current has a high surface roughness, and hence has low water-repellent and oil-repellent functions. For this reason, adhering of fuel and adhering of unburned materials to a head surface of a piston for an internal combustion engine occur. Consequently, there arises a problem of engine trouble due to the adhering of the deposit. For example, in an anodic oxide coating formed by a direct-current electrolysis method alone, multiple cylindrical pores are present in the surface of the anodic oxide coating, and hence, improvement in heat insulation properties and corrosion resistance cannot be expected.

In addition, when the pores of an anodic oxide coating are sealed by a sealing treatment, the pores may be filled to a great extent, and hence, there arises a problem of degradation of the heat insulation properties of the anodic oxide coating. Furthermore, the sealing treatment is conducted by using a treatment liquid which has different components from the components of that used in the anodizing treatment. For this reason, adhesion failure, peeling, or the like may occur between a portion subjected to the sealing treatment and the anodic oxide coating. In other words, there arises a problem of possible degradation of the durability of the anodic oxide coating. Furthermore, the sealing treatment step is conducted as a separate step after the anodizing treatment step. Accordingly, the formed inner pores may be blocked during transfer between the steps. This causes a problem of degradation of heat resistance. Moreover, this increases the number of steps and control items, causing a problem of increased production costs.

Moreover, to obtain an anodic oxide coating having a porosity of 25% or higher and a film thickness of 50 μm or more, especially having a porosity of about 30% and a film thickness of about 100 μm, the anodizing treatment has to be conducted for 2 hours or more. For example, according to an example of Japanese Patent Application Publication No. 2010-249008 (PTL 3) mentioned above, the formation of a coating having a porosity of 30% and a film thickness of 100 μm requires a treatment for a long period of 4 hours. For this reason, there arises a problem of a low formation speed of the anodic oxide coating and a resultant poor formation efficiency of the anodic oxide coating.

Furthermore, if a high voltage is applied to satisfy the above-described requirements, the distribution of the current in the aluminum-based material 1 becomes uneven, and black spots are formed by burning of the coating due to the local concentration of current, and the surface of the coating is coarsened. For this reason, there arises a problem such that the interface between the anodic oxide coating and the aluminum-based material is not flat, and the film thickness is not uniform. In addition, the size of the applicable voltage is limited.

In contrast, in the configuration according to this embodiment, the first anodic oxide coating 2*a* formed by direct-current electrolysis and having high heat insulation properties is provided on the aluminum-based material 1 side, and the second anodic oxide coating 2*b* formed by AC-DC superimposition electrolysis and having a high corrosion resistance is provided on the outer peripheral side of the first anodic oxide coating 2*a*. For this reason, the second anodic oxide coating 2*b* formed by AC-DC superimposition electrolysis functions as a lid covering the outer periphery of the first anodic oxide coating 2*a* formed by direct-current electrolysis, and covers the nano-level and micro-level first pores of the first anodic oxide coating 2*a*, without filling the pores. This makes it possible to obtain an anodic oxide coating 2 having both high heat insulation properties and a high corrosion resistance.

In addition, since the first anodic oxide coating 2*a* has more pores than the second anodic oxide coating 2*b*, the heat insulation properties of the aluminum-based material 1 can be improved. Consequently, the use for a combustion chamber in an internal combustion engine can improve the fuel-efficiency. In addition, although the surface hardness and smoothness are lowered by the pores of the first anodic oxide coating 2*a*, the surface of the aluminum-based material 1 can be dense and flat and smooth because of the presence of the second anodic oxide coating 2*b* having few pores and provided on the surface of the first anode oxide coating 2*a*. Consequently, the aluminum-based material 1 is suitable for the use for a combustion chamber in an internal combustion engine where durability and slidability are required.

Moreover, the second anodic oxide coating 2*b* formed by AC-DC superimposition electrolysis and having a high density and a high hardness is configured to be the upper layer in the anodic oxide coating 2. For this reason, when the anodic oxide coating 2 is used for a structure of an internal combustion engine, for example, a piston for an internal combustion engine, it is possible to obtain an anodic oxide coating 2 having high durability and impact resistance enough to withstand the repeated stress due to the explosion pressure, the injection pressure, the thermal expansion, and the thermal contraction during the combustion. In addition, the second anodic oxide coating 2*b* can be configured to be provided on a head surface. Consequently, it is possible to obtain an anodic oxide coating 2 sufficient to withstand use for a piston for an internal combustion engine.

Furthermore, the second anodic oxide coating 2*b* formed by AC-DC superimposition electrolysis has a low surface roughness. In other words, the smoothness of the surface of the second anodic oxide coating 2*b* is high. For this reason, the second anodic oxide coating 2*b* and the anodic oxide coating 2 having the second anodic oxide coating 2*b* as the upper layer have high water repellency and high oil repellency. In addition, the second anodic oxide coating 2*b* and the anodic oxide coating 2 have small surface areas, and hence, receive less heat. Accordingly, when the anodic oxide coating 2 is used for a structure of an internal combustion engine, for example, a piston for an internal combustion engine, it is possible to prevent adhering of fuel and adhering of unburned materials to the head surface, because the second anodic oxide coating 2*b* is provided on a head surface. Accordingly, engine trouble due to adhering of deposit can be prevented from occurring.

In addition, according to this embodiment, the second anodic oxide coating 2*b* formed by AC-DC superimposition electrolysis in the first anodic oxide coating formation step is a dense coating with a high strength. For this reason, even when a treatment liquid with a low concentration is used, and a high current density is applied in the step of application of direct-current electrolysis after the step of application of AC-DC superimposition electrolysis, the formation speed of the coating can be increased, without allowing the formation of irregularities and the occurrence of color change on the surface of the second anodic oxide coating 2*b* due to the burning of the coating. This makes it possible to improve the formation efficiency of a coating with a uniform film thickness. In addition, for example, an anodizing treatment for obtaining a porosity of the first anodic oxide coating 2*a* of 25% or higher, a film thickness of the anodic oxide coating 2 of 50 μm or more as described above, further a porosity of the anodic oxide coating 2 of about 30%, and a film thickness of the anodic oxide coating 2 of about 100 μm can be conducted in a relatively short period of about 10 minutes.

In addition, the range of the current density in the second anodic oxide coating formation step in which the first anodic oxide coating 2*a* is formed is set to 1 A/dm$^2$ or higher. This makes it possible to apply a high voltage of 40 V or higher to the surface of the aluminum-based material 1, and improve the porosity of the first anodic oxide coating 2*a*. In addition, this increases the formation speed of the coating, so that the formation efficiency of the coating can be improved. Moreover, the current density of the direct-current electrolysis applied in the second anodic oxide coating formation step in which the first anodic oxide coating 2*a* is formed is set to 80 A/dm$^2$ or lower. This makes it possible to appropriately control the voltage applied to the surface of the aluminum-based material 1, and improve the porosity of the first anodic oxide coating 2*a*, while preventing the formation of irregularities or the occurrence of color change on the surface of the second anodic oxide coating 2*b* due to the burning of the coating.

Moreover, the first anodic oxide coating 2*a* is formed with the concentration of the acid component in the treatment liquid in the second anodic oxide coating formation step in which the first anodic oxide coating 2*a* is formed being set to 10 g/L or higher. This causes dissolution of aluminum on the surface of the aluminum-based material 1, and hence the first anodic oxide coating 2*a* can be formed, and the formation efficiency of the coating can be improved. For example, in a state in which the dissolution of aluminum does not occur on surface of the aluminum-based material 1, a large voltage is applied locally on the surface of the aluminum-based material 1, and consequently the surface temperature rises. For this reason, there is a possibility that irregularities may be formed and color change may occur on the surface of the second anodic oxide coating 2*b* due to the burning of the coating. In addition, the mass/volume concentration (g/L) of the acid component in the treatment liquid is set to be lower than 100 g/L. This makes it possible to improve the porosity of the first anodic oxide coating 2*a*, without allowing the formation of irregularities or the occurrence of color change on the surface of the second anodic oxide coating 2*b* due to the burning of the coating.

Furthermore, the concentration of the acid component in the first anodizing treatment liquid used in the first anodic oxide coating formation step in which the second anodic oxide coating 2*b* is formed is set to 100 g/L or higher. This causes the dissolution of aluminum on the surface of the aluminum-based material 1, making it possible to form the second anodic oxide coating 2*b* on the surface of the aluminum-based material 1. Consequently, the formation efficiency of the coating can be further improved. In addition, the mass/volume concentration is set to be lower than 600 g/L. This makes it possible to make such an appropriate control that the dissolution speed of aluminum cannot be equal to or exceed the formation rate of the coating on the surface of the aluminum-based material 1, so that the second anodic oxide coating 2*b* can be formed on the surface of the aluminum-based material 1.

In addition, according to this embodiment, the porosity of the first anodic oxide coating 2*a* can be 25% or higher. Consequently, the heat insulation properties of the first anodic oxide coating 2*a* can be improved by causing many nano-level and macro-level pores to be present in the coating. It is difficult to obtain a porosity of 25% or higher by an approach of simply forming only the first anodic oxide coating 2*a* on the surface of the aluminum-based material. In contrast, the combination of the first anodic oxide coating 2*a* with the second anodic oxide coating 2*b* can achieve a porosity of 25% or higher. Moreover, by setting the porosity of the first anodic oxide coating 2*a* to 75% or lower, an anodic oxide coating 2 having an appropriate strength can be formed, and can be used for a combustion chamber in an internal combustion engine in which a high durability is required.

Moreover, the film thickness of the second anodic oxide coating 2*b* is set to 10 μm or more. This can prevent local application of a large voltage in the formation of the first anodic oxide coating 2*a*, so that a high voltage of 40 V or higher can be applied stably from the beginning to the end of the electrolysis without causing burning of the coating. Consequently, a coating with a porosity of 25% or higher can be obtained. If the film thickness of the second anodic oxide coating 2*b* is less than 10 μm, spots may be formed on the surface during the formation of the first anodic oxide coating 2*a* by the direct-current electrolysis method, so that dissolution or the like may occur. Moreover, even when a high current density is applied in the formation of the first anodic oxide coating 2*a*, the burning of the coating can be prevented, and the formation speed of the coating can be increased, so that the formation efficiency of the uniform coating can be improved. In addition, the film thickness of the second anodic oxide coating 2*b* is set to 200 μm or less. This can further shorten the formation time of the anodic oxide coating 2, and can impart appropriate slidability and durability to the second anodic oxide coating 2*b*. Consequently, it is possible to obtain a anodic oxide coating 2 more suitable for a combustion chamber in an internal combustion engine.

Furthermore, the film thickness of the first anodic oxide coating 2*a* is made larger than the film thickness of the second anodic oxide coating 2*b*, and the total film thickness of the first anodic oxide coating 2*a* and the second anodic oxide coating 2*b* is set to 50 μm or more. This makes it possible to impart, to the aluminum-based material 1, heat insulation properties based on the first anodic oxide coating 2*a* and durability and slidability based on the second anodic oxide coating 2*b*. In addition, the total film thickness of the first anodic oxide coating 2*a* and the second anodic oxide coating 2*b* is set to 500 μm or less. This makes it possible to shorten the time for forming the anodic oxide coating 2, and impart appropriate heat insulation properties and durability to the anodic oxide coating 2. Consequently, the anodic oxide coating 2 can be used suitably for a combustion chamber in an internal combustion engine.

Furthermore, according to this embodiment, the components of the first anodic oxide coating 2*a* and the components of the second anodic oxide coating 2*b* are substantially the same, and the first anodic oxide coating 2*a* and the second anodic oxide coating 2*b* are formed continuously.

This makes it possible to obtain an integrated and firm connecting portion between the first anodic oxide coating 2*a* formed by direct-current electrolysis and the second anodic oxide coating 2*b* formed by AC-DC superimposition electrolysis. Consequently, many first pores of the first anodic oxide coating 2*a* are prevented from being filled, so that the degradation of the high heat insulation properties of the first anodic oxide coating 2*a* can be prevented. In addition, it is possible to prevent occurrence of adhesion failure, peeling, or the like between the anodic oxide coatings. This makes it possible to obtain highly-reliable heat insulation properties and a highly-reliable durability.

Other Embodiments

Note that, in the above-described embodiments, the anodic oxide coating 2 having the two-layer structure including the first anodic oxide coating 2*a* and the second anodic oxide coating 2*b* is shown as an example; however, the present invention is not limited thereto. For example, many layers of first anodic oxide coatings 2*a* and second anodic oxide coatings can be provided alternately by alternately repeating the second anodic oxide coating formation step based on the AC-DC superimposition electrolysis treatment and the first anodic oxide coating formation step based on the direct-current electrolysis treatment. In this case, better heat insulation properties and a better corrosion resistance can be imparted to the anodic oxide coating than in the case of the above-described embodiment.

In addition, in the above-described embodiment, the suitable use of the aluminum-based material for a structure of an internal combustion engine is shown as an example; however, the present invention is not limited thereto. The aluminum-based material may be a component for an outboard engine such as an oil pan, a gear case, a propeller, or the like for an outboard engine. An outboard engine is a propulsion system adhering to a marine vessel, and comes into contact with seawater and salt air. Hence, components constituting an outboard engine are required to have high corrosion resistance. For example, an oil pan, which stores an engine oil and also has a function to cool the engine oil with a stream of air during a cruise, has to come into direct contact with seawater and salt air. For this reason, a high corrosion resistance is required. The anodic oxide coating formed on the aluminum-based material of the present invention has a sufficient corrosion resistance, and hence can also be used as a component for an outboard engine.

EXAMPLES

Hereinafter, the present invention will be described specifically based on Examples to clarify effects of the present invention. Neither the anodizing treatment method nor the structure of an internal combustion engine according to the present invention is limited to the examples below.

Test Example 1

A test piece prepared from an aluminum alloy (AC8A) was used as an aluminum-based material. The AC8A used was anodized by a direct-current electrolysis method to form an anodic oxide coating of 11 to 21 μm. The anodizing treatment was conducted at 1.5 A/dm$^2$ for 20 minutes in a sulfuric acid bath having a concentration of 200 g/L at 20° C. The fabricated test piece having a single-layer anodic oxide coating constituted of the anodic oxide layer formed by direct-current electrolysis was employed as a test piece of Test Example 1.

Test Example 2

A test piece prepared from an aluminum alloy (AC8A) was used as an aluminum-based material. The AC8A was anodized by an AC-DC superimposition electrolysis method to form a coating of 16 to 18 μm. The anodizing treatment was conducted for 10 minutes in a sulfuric acid bath having a concentration of 200 g/L at 20° C. with 10 kHz and with a positive electrode at 25 V and a negative electrode at −2 V. The fabricated test piece having a single-layer anodic oxide coating constituted of the anodic oxide layer formed by AC-DC superimposition electrolysis was employed as a test piece of Test Example 2.

Test Example 3

A test piece prepared from an aluminum alloy (AC8A) was used as an aluminum-based material. The AC8A was subjected to an anodizing treatment by an AC-DC superimposition electrolysis method to form a coating. The anodizing treatment was conducted for 7 minutes in a sulfuric acid bath having a concentration of 200 g/L at 20° C. with 10 kHz and with a positive electrode at 25 V and a negative electrode at −2 V. After that, a coating was formed by an anodizing treatment using a direct-current electrolysis method. The anodizing treatment was conducted at 1.5 A/dm$^2$ for 10 minutes in the sulfuric acid bath having a concentration of 200 g/L at 20° C. The film thickness was 17 to 22 μm. The fabricated test piece having an anodic oxide coating having a two-layer structure constituted of the anodic oxide layer formed by direct-current electrolysis and the anodic oxide layer formed by AC-DC superimposition electrolysis was employed as a test piece of Test Example 3.

Evaluation of Density, Hardness, and Surface Roughness

The density (g/cm$^3$), the hardness (HV), and the surface roughness (Ra) of each of the test pieces of Test Examples 1 to 3 were measured and calculated, and the values were examined. The density (g/cm$^3$) relating to the porosity was measured as follows. Specifically, the density of the aluminum alloy was determined in advance from its weight and volume. Then, the weight of the anodic oxide coating was calculated from the difference between the weight of the test piece on which the coating was formed and the weight corresponding to the thickness of the aluminum alloy, and the density was calculated from the thickness and area of the anodic oxide coating. Note that a higher density indicates a lower porosity. The hardness (HV) was measured with a Vickers hardness tester. Meanwhile, the surface roughness (Ra) was measured with a surface roughness tester. Table 1 shows the values of the density, the hardness, and the surface roughness of each of the test pieces of Test Examples 1 to 3. Note that since the test piece of Test Example 3 had a two-layer structure with different hardness, the hardness was not measured for Test Example 3.

TABLE 1

| | Test Ex. 1 | Test Ex. 2 | Test Ex. 3 |
|---|---|---|---|
| Layer structure | One layer | One layer | Two layers |
| Density [g/cm$^3$] | 1.59 | 2.22 | 1.95 |
| Hardness [HV] | 366 | 412 | — |
| Surface roughness [Ra] | 3.2 | 1.2 | 1.5 |

As shown in Table 1, a comparison between Test Example 1 and Test Example 2 shows that the surface roughness was lower and the density was higher in Test Example 2 than in Test Example 1. From this result, it can be seen that an anodic oxide coating formed by AC-DC superimposition electrolysis has a higher water repellency, a higher oil repellency, and a higher impact resistance, and makes a greater contribution to the improvement of heat insulation properties than an anodic oxide coating formed by direct-current electrolysis. In addition, it can also be seen that an anodic oxide coating formed by direct-current electrolysis has higher heat insulation properties than an anodic oxide coating formed by AC-DC superimposition electrolysis.

A comparison between Test Example 1 and Test Example 3 shows that the test piece of Test Example 3 had a lower surface roughness and a higher density than that of Test Example 1. From this result, it can be seen that an anodic oxide coating having a two-layer structure in which an anodic oxide layer formed by AC-DC superimposition electrolysis is present as an upper layer, and an anodic oxide layer formed by direct-current electrolysis is present as a lower layer has a higher water repellency, a higher oil repellency, and a higher impact resistance than an anodic oxide coating having a single-layer structure of an anodic oxide layer formed by direct-current electrolysis. In addition, it can be seen that an anodic oxide coating having the two-layer structure achieves both high heat insulation properties and high impact resistance. Regarding these functions, when an anodic oxide coating having the two-layer structure is applied to a structure of an internal combustion engine, especially, a combustion chamber in an internal combustion engine, the anodic oxide coating can be expected to exhibit a high impact resistance sufficient for practical use, and exert an effect of reducing adhering matter before and after combustion and an effect of improving the corrosion resistance.

Corrosion Resistance Test

As a corrosion resistance test, the salt spray test specified in JIS Z 2371 (International Standard: ISO 9227) was conducted on each of the test pieces of Test Examples 1 to 3 for 1000 hours. After that, the test pieces were dried, and then the degrees of corrosion were compared with each other by visual inspection. Note that the test pieces used for the evaluation of the corrosion resistance were cut out from the test pieces fabricated in Test Examples 1 to 3, and the peripheries thereof were masked. Part (a) of FIG. 3 shows the result of the corrosion resistance test conducted on the test piece of Test Example 1, Part (b) of FIG. 3 shows the result of the corrosion resistance test conducted on the test piece of Test Example 2, and Part (c) of FIG. 3 shows the result of the corrosion resistance test conducted on the test piece of Test Example 3.

Figure 3A:
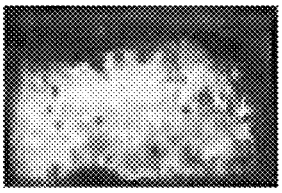
FIG. 3 Part (a) to (c) of FIG. 3 are photographs showing results of a corrosion resistance test in Examples relating to the anodizing treatment method and the structure of an internal combustion engine according to the present invention.
Figure 3B:
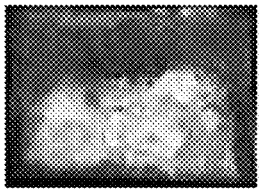
Figure 3C:
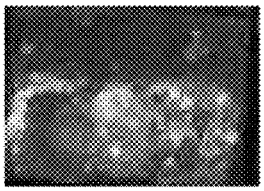

As shown in Parts (a) and (b) of FIG. 3, a comparison between Test Example 1 and Test Example 2 shows that the area where the aluminum alloy was exposed or the corrosion occurred was smaller in the test piece of Test Example 2 than in that of Test Example 1. From this result, it was found that the anodic oxide coating formed by AC-DC superimposition electrolysis had a higher corrosion resistance than the anodic oxide coating formed by direct-current electrolysis.

As shown in Parts (a) and (c) of FIG. 3, a comparison between Test Example 1 and Test Example 3 shows that the area where the aluminum alloy was exposed or the corrosion occurred was smaller in the test piece of Test Example 3 than in that of Test Example 1. From this result, it was found that the test piece of Test Example 3 having the anodic oxide coating having the two-layer structure in which the anodic oxide layer formed by AC-DC superimposition electrolysis was present as the upper layer, and the anodic oxide layer formed by direct-current electrolysis was present as the lower layer had a higher corrosion resistance than the anodic oxide coating having the single-layer structure formed by AC-DC superimposition electrolysis.

As shown in Parts (b) and (c) of FIG. 3, a comparison between Test Example 2 and Test Example 3 shows that the area where the aluminum alloy was exposed or the corrosion occurred was smaller in the test piece of Test Example 3 than in that of Test Example 2. From this result, it was found that the test piece of Test Example 3 having the anodic oxide coating in which the anodic oxide layer formed by AC-DC superimposition electrolysis was present as the upper layer, and the anodic oxide layer formed by direct-current electrolysis was present as the lower layer had a higher corrosion resistance than the single-layer anodic oxide coating formed by AC-DC superimposition electrolysis.

Figure 4:
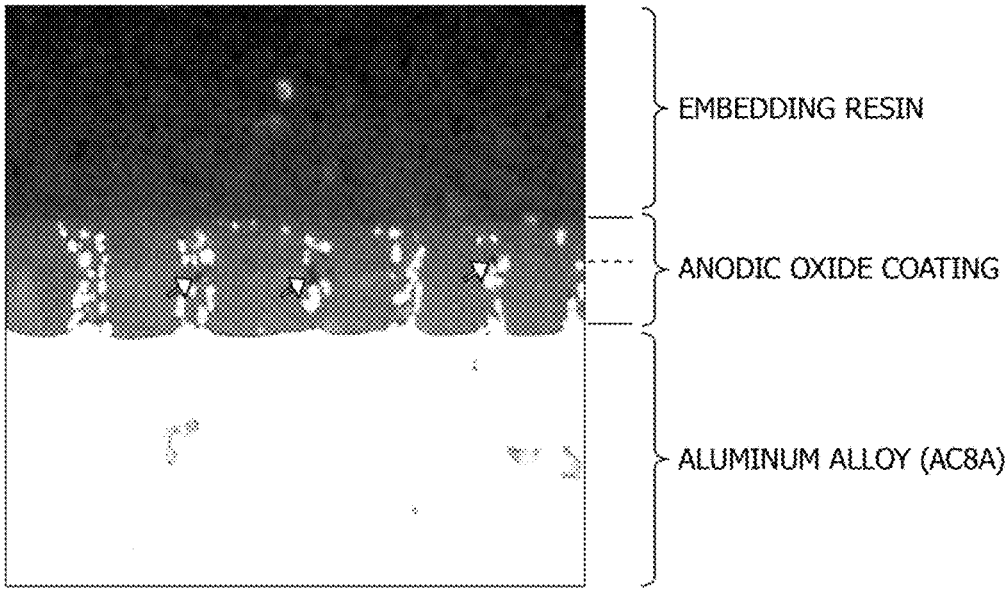
FIG. 4 is a cross-sectional photograph showing a result of an example relating to the anodizing treatment method and the structure of an internal combustion engine according to the present invention.

FIG. 4 is a cross-sectional photograph of the test piece subjected to the film formation in Test Example 3 taken by using an optical microscope after the corrosion resistance test was carried out. In FIG. 4, the layer in the anodic coating above the dashed line on the paper represents the coating formed by AC-DC superimposition electrolysis, the layer below the dashed line on the paper represents the coating formed by direct-current electrolysis, and major pore portions in the anodic oxide coating are indicated by using the arrows.

As shown in FIG. 4, in the test piece fabricated in Test Example 3, the second anodic oxide layer by the AC-DC superimposition electrolysis treatment was formed as the upper layer in the anodic oxide layer, and the first anodic oxide layer by the direct-current electrolysis treatment was formed as the lower layer in the anodic oxide layer. In other words, it was confirmed that an anodic oxide coating having a two-layer structure was formed in the test piece of Test Example 3. In addition, it was confirmed that the anodic oxide coating having the two-layer structure was formed on the aluminum alloy.

In the anodic oxide layer formed by direct-current electrolysis and serving as the lower layer, pores were formed at the sites where the presence of silicon inhibited the formation of the coating, and therefore, the coating was not formed. Micro-level pores were present in the coating formed by the direct-current electrolysis treatment and serving as the lower layer, whereas such pores were not present in the coating formed by the AC-DC superimposition electrolysis treatment and serving as the upper layer. In addition, no micro-level pores were observed around the silicon in the coating, and it was found that the coating surely covered the vicinity of the silicon.

Test Example 4

To facilitate the quantitative determination of the porosity, aluminum (pure aluminum) not containing silicon and having a purity of 99.999 was used as an aluminum-based material. On the aluminum-based material, anodic oxide coatings of film thicknesses of 24 μm to 60 μm were formed with a constant current density by a direct-current electrolysis method under various treatment conditions. The coatings formed under various treatment conditions were employed as test pieces (Nos. 1 to 5) of Test Example 4. The treatment conditions were as follows. Specifically, the temperature was 20° C., the concentrations of sulfuric acid baths were in the range from 10 g/L to 200 g/L, the current densities were in the range from 8 A/dm$^2$ to 32 A/dm$^2$, and the treatment time was 10 minutes. Note that the initial voltages at concentrations of 100 g/L to 200 g/L were 18.5 V to 25 V, and the initial voltage increased at lower concentrations.

Evaluation of Coating Properties I

Surfaces and cross-sections of the test pieces (Nos. 1 to 5) of Test Example 4 were observed by using an optical microscope, and the coating properties of the test pieces were evaluated. Each test piece was observed for the presence or absence of burning of the coating, color change, and irregularities.

Figure 5A:
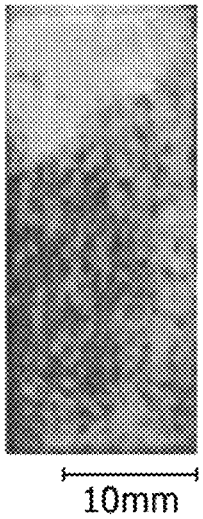
FIG. 5 Parts (a) to (c) of FIG. 5 are surface and cross-sectional photographs showing results in Examples relating to the anodizing treatment method and the structure of an internal combustion engine according to the present invention.
Figure 5B:
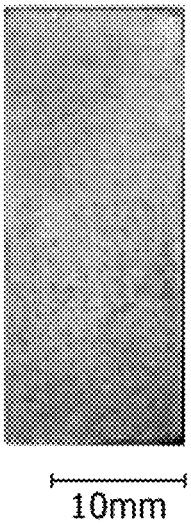
Figure 5C:
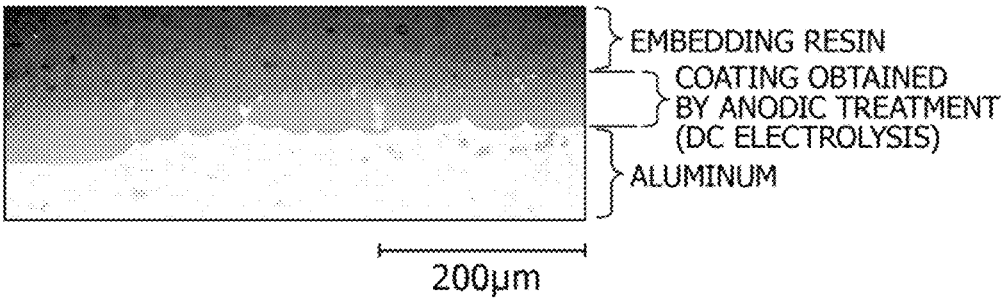

Of the fabricated coatings of Nos. 1 to 5, Part (a) of FIG. 5 shows a photograph of a surface of the coating of No. 2, Part (b) of FIG. 5 shows a photograph of a surface of the coating of No. 4, and Part (c) of FIG. 5 shows a photograph of a cross section of the coating of No. 2. For each of the cross-sectional photographs, the substrate on which the coating was formed was embedded in a resin, and the surface was polished, before the observation. As shown in Part (a) of FIG. 5, the portions with a deep color shown on the surface of the coating are sites where burning of the coating occurred. Burning of the coating was observed in the coating of No. 2. In contrast, as shown in Part (b) of FIG. 5, the coating of No. 4 had a uniform color, and did not undergo such burning of the coating. In addition, as shown in Part (c) of FIG. 5, irregularities were observed in the cross-section of the coating. When irregularities are present or color change occurs, the surface of the coating becomes non-uniform, and it is not possible to prevent the adhering of fuel or the adhering of unburned materials. Moreover, the formation of pores is disadvantageous to the heat insulation properties.

The surfaces and cross-sections of the other test pieces were also observed in the same manner. Note that, in the surface observation, test pieces not having irregularities or color change due to burning of the coating were evaluated to be "good," whereas test pieces having irregularities or color change due to burning of the coating were evaluated to be "poor." In addition, for each test piece with good coating properties, the porosity (%) was calculated by measuring the cell diameter and the pore diameter using an electron microscope. The porosity was calculated as follows. A cross-sectional photograph of a test piece having an anodic oxide coating was taken, and three measuring sites were selected at random. Assuming that cells and pores are substantially cylindrical, three cells each sectioned in the longitudinal direction by a line passing near the center of the cylinder were selected in each measuring site, and the diameters of a cell and a pore were measured near a substantial center in the thickness direction of the anodic oxide coating. From the measured diameters, the volume of the cell and the volume of the pore were calculated, and the porosity (%) was calculated. This calculation was conducted at the 9 points, and the average value of the porosities calculated for these points was employed as the porosity of the anodic oxide coating. For coatings with extremely small film thicknesses, the porosity was not measured. Table 2 below shows the evaluation results of each of the test pieces (Nos. 1 to 5).

TABLE 2

| No. | Concentration [g/L] | Voltage [V] | Current density [A/dm$^2$] | Time [min.] | Film thickness [μm] | Coating properties Porosity (%) |
|---|---|---|---|---|---|---|
| 1 | 10 | — | 8 | 10 | — | Poor — |
| 2 | 25 | — | 8 | 10 | — | Poor — |
| 3 | 25 | — | 32 | 10 | — | Poor — |
| 4 | 100 | — | 8 | 10 | 24 | Good 8% |
| 5 | 200 | — | 8 | 10 | 32 | Good 11% |

From these results, it has been found that when the concentration of the treatment liquid for the direct-current electrolysis treatment is low as in the cases of the test pieces Nos. 1 to 3, burning of the coating occurs because of the high applied voltage, although the porosity of the formed coating can be high. In addition, it was found that when the concentration of the treatment liquid for the direct-current electrolysis treatment was high as in the case of the test pieces Nos. 4 and 5, no burning of the coating occurs, but the film thickness formation speed is low, and the porosity is also low.

Test Example 5

The same pure aluminum as that in Test Example 4 was used as an aluminum-based material. On the aluminum-based material, anodic oxide coatings were formed with a constant current density by an AC-DC superimposition electrolysis method under various treatment conditions. Multiple test pieces prepared under various treatment conditions were employed as test pieces (Nos. 1 to 6) of Test Example 5. The treatment conditions were as follows. Specifically, the temperature was 20° C., the concentrations of sulfuric acid baths were in the range from 10 g/L to 200 g/L, the frequency was in the range from 1 kHz to 12 kHz, the voltage of a positive electrode was 20 V to 28 V, the voltage of a negative electrode was −2 V, and treatment time was 1 to 5 minutes. The film thicknesses of the coatings successfully formed were in the range from 1 μm to 70 μm.

Evaluation of Coating Properties II

The coating properties of each of the test pieces (Nos. 1 to 6) of Test Example 5 were evaluated in the same manner as in Evaluation of Coating Properties I. Note that the coating properties of a coating with an extremely small film thickness were not evaluated. In addition, the porosity of each coating formed by the AC-DC superimposition electrolysis method in this example was low, and hence was not calculated. Table 3 shows the evaluation results.

TABLE 3

| No. | Concentration [g/L] | Frequency [kHz] | Voltage [V] | Time [min.] | Film thickness [μm] | Coating properties |
|---|---|---|---|---|---|---|
| 1 | 10 | 10 | 20 | 5 | — | — |
| 2 | 25 | 10 | 25 | 2 | 1 | poor |
| 3 | 100 | 10 | 25 | 5 | 70 | good |
| 4 | 200 | 1 | 20 | 5 | 20 | good |
| 5 | 200 | 12 | 25 | 1 | 7 | good |
| 6 | 200 | 12 | 28 | 5 | 45 | good |

From the results, it has been found that when the concentration of the treatment liquid for the AC-DC superimposition electrolysis treatment is low as in the case of the test pieces Nos. 1 and 2, it is difficult to form the coating. In addition, when the concentration of the treatment liquid for the AC-DC superimposition electrolysis treatment was high as in the case of each of the test pieces Nos. 3 to 6, it was easy to form the coating with a large film thickness, but the coating was dense and hence had a low porosity.

Test Example 6

The same pure aluminum as that in Test Examples 4 and 5 was used as an aluminum-based material. On the aluminum-based material, a dense coating was formed by the AC-DC superimposition electrolysis method as in the case of Test Example 5, and then another coating was formed by an anodizing treatment using the direct-current electrolysis method as in the case of Test Example 4. Multiple test pieces were fabricated under various treatment conditions for anodic oxide coatings. The fabricated test pieces were employed as test pieces (Nos. 1 to 14) of Test Example 6.

Evaluation of Coating Properties III

The coating properties and the porosity of each of the test pieces (Nos. 1 to 14) of Test Example 6 were evaluated in the same manner as in Evaluation of Coating Properties I and II. Table 4 shows the treatment conditions and the evaluation results. Note that the coating properties of coatings with extremely small film thicknesses were not evaluated. In addition, among the coatings formed in this example, the porosities of coatings with poor coating properties were not calculated.

TABLE 4

| No. | Layer structure | Conc. [g/L] | Freq. [kHz] | Voltage [V] | Current density [A/dm$^2$] | Time [min.] | Film thickness [μm] | Coating properties Porosity (%) |
|---|---|---|---|---|---|---|---|---|
| 1 | 2nd layer | 200 | 12 | 25 | | 2 | 24 | good |
| | 1st layer | 25 | (DC) | | 32 | 10 | 126 | 30% |
| 2 | 2nd layer | 100 | 12 | 25 | | 5 | 48 | good |
| | 1st layer | 25 | (DC) | | 32 | 10 | 109 | 30% |
| 3 | 2nd layer | 200 | 12 | 25 | | 2 | 22 | good |
| | 1st layer | 10 | (DC) | | 32 | 10 | 96 | 30% |
| 4 | 2nd layer | 200 | 12 | 25 | | 1.5 | 14 | good |
| | 1st layer | 10 | (DC) | | 8 | 10 | 37 | 25 |
| 5 | 2nd layer | 500 | 12 | 25 | | 2 | 31 | good |
| | 1st layer | 25 | (DC) | | 32 | 10 | 107 | 31% |
| 6 | 2nd layer | 200 | 12 | 25 | | 1.5 | 14 | good |
| | 1st layer | 15 | (DC) | | 16 | 10 | 52 | 30% |
| 7 | 2nd layer | 200 | 12 | 25 | | 2 | — | poor |
| | 1st layer | 5 | (DC) | | 32 | 10 | — | — |
| 8 | 2nd layer | 600 | 12 | 25 | | 2 | — | poor |
| | 1st layer | 25 | (DC) | | 32 | 10 | — | — |
| 9 | 2nd layer | 700 | 12 | 25 | | 2 | — | poor |
| | 1st layer | 25 | (DC) | | 32 | 10 | — | — |
| 10 | 2nd layer | 200 | 12 | 25 | | 2 | 20 | good |
| | 1st layer | 100 | (DC) | | 8 | 10 | 24 | 21% |
| 11 | 2nd layer | 50 | 12 | 25 | | 2 | — | poor |
| | 1st layer | 25 | (DC) | | 32 | 10 | — | — |
| 12 | 2nd layer | 80 | 12 | 25 | | 2 | — | poor |
| | 1st layer | 25 | (DC) | | 32 | 10 | — | — |
| 13 | 2nd layer | 200 | 1 | 25 | | 5 | 9.5 | good |
| | 1st layer | 200 | (DC) | | 16 | 10 | 40 | 20% |
| 14 | 2nd layer | 200 | 12 | 25 | | 1 | 8 | poor |
| | 1st layer | 25 | (DC) | | 32 | 10 | — | — |

From the results, it was found that each of the test pieces Nos. 1 to 6 achieved good coating properties and a value of the porosity of 25% or higher by combining the first anodic oxide coating and the second anodic oxide coating. It has been found that this makes it possible to improve the heat insulation properties of the first anodic oxide coating. Moreover, first anodic oxide coatings were successfully formed with porosities of 75% or lower. Accordingly, such a coating has an appropriate strength. When the coating is employed for a structure of an internal combustion engine, especially, a combustion chamber in an internal combustion engine where a high durability is required, the coating can be expected to exhibit an effect.

From a comparison among the test pieces Nos. 1 to 6, it has been found that the current density in the direct-current electrolysis method for forming the first anodic oxide coating is more preferably 4 A/dm$^2$ or higher, and further preferably 8 A/dm$^2$ or higher. In addition, it has been found that the current density in the direct-current electrolysis method is further preferably 40 A/dm$^2$ or lower, and particularly preferably 32 A/dm$^2$ or lower. It has been found that, within these ranges, it is possible to reduce the possibility that burning of the coating may occur on the surface of the anodic oxide coating, while improving the formation efficiency by forming the oating in a short period of 10 minutes.

From a comparison among the test pieces Nos. 1, 3, and 7, it has been found that the concentration of the acid component in the treatment liquid is preferably 10 g/L or higher in the second anodic oxide coating formation step for forming the first anodic oxide coating. Moreover, from a comparison among the test pieces Nos. 1, 10, and 13, it has been found that the concentration of the acid component in the treatment liquid is preferably lower than 100 g/L, and further preferably 25 g/L or lower. It has been found that, within these ranges, an anodic oxide coating can be formed in a short period with good coating properties, a uniform film thickness, and a porosity of the coating of 25% or higher, and more preferably 30% or higher.

A comparison among the test pieces Nos. 1, 11, and 12, it has been found that the concentration of the acid component in the treatment liquid is preferably 100 g/L or higher, and more preferably exceeds 80 g/L in the first anodic oxide coating formation step for forming the second anodic oxide coating. Moreover, from a comparison among the test pieces Nos. 1, 5, 8, 9, 11, and 12, it has been found that the concentration of the acid component in the treatment liquid is preferably lower than 600 g/L, and is more preferably 500 g/L or lower in the first anodic oxide coating formation step. It has been found that, within these ranges, an anodic oxide coating can be formed in a short period with good coating properties, a uniform film thickness, and a porosity of the coating of 25% or higher, and more preferably 30% or higher.

Regarding the porosity of the first anodic oxide coating, the results of Table 1 indicate that when the coating was formed by the direct-current electrolysis method in a short period, for example, about 10 minutes, the porosity of the obtained anodic oxide coating was only 1% to 8%, or about 15% at the highest. In contrast, in each of the test pieces Nos. 1 to 6, the anodic oxide coating having a porosity of 25% or higher was successfully formed in an extremely short period of about 10 minutes. The time taken by the anodizing treatment was 11.5 minutes to 15 minutes. Specifically, the second anodic oxide coating was formed by a treatment in 1.5 minutes to 5 minutes, and the first anodic oxide coating was formed in a treatment for 10 minutes. However, when the coating was treated by the AC-DC superimposition electrolysis method in one minute as in the case of the test piece No. 14, and then a coating was formed by the direct-current electrolysis, burning of the coating occurred. As described above, it has been found that a certain film thickness is necessary, although this depends on the electrolysis conditions. From a comparison among the test pieces Nos. 1 to 6 and 14, it has been found that the burning of the coating can be prevented when the film thickness of the first anodic oxide coating is 10 μm or more.

A comparison among the test pieces Nos. 1 to 6 and 7 to 14 showed that the coatings having film thicknesses within the range from 51 μm to 157 μm had good coating properties and high porosities of 25% or higher. From the results, it has been found that it is preferable that the film thickness of the first anodic oxide coating be greater than the film thickness of the second anodic oxide coating, and that the total film thickness of the first anodic oxide coating and the second anodic oxide coating be 50 μm or more.

Figure 6A:
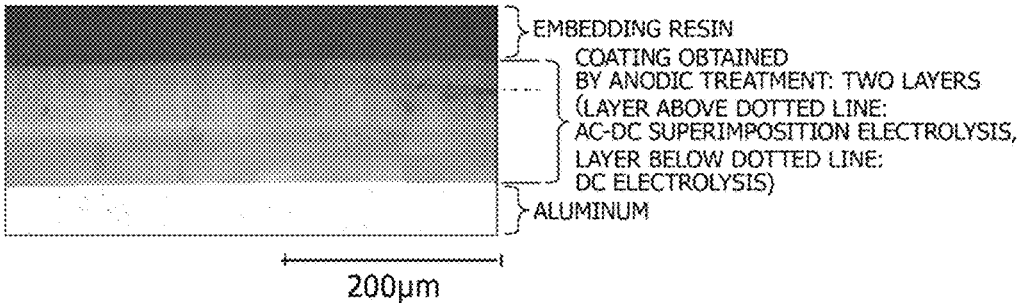
FIG. 6 Parts (a) and (b) of FIG. 6 are cross-sectional photographs showing results of an example relating to the anodizing treatment method and the structure of an internal combustion engine according to the present invention.
Figure 6B:
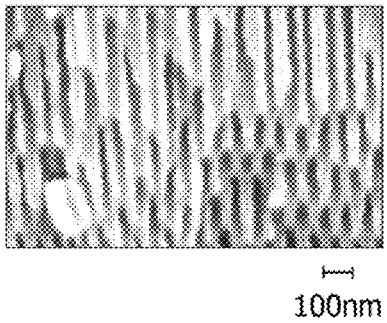

Part (a) of FIG. 6 shows cross-sectional photograph of the test piece No. 1 of Test Example 6. Meanwhile, Part (b) of FIG. 6 shows a fracture surface of the anodic oxide coating formed by the direct-current electrolysis method of Part (a) of FIG. 6. The coating of No. 1 was an anodic oxide coating formed by an AC-DC superimposition electrolysis method with a frequency of 12 kHz at 25 V in a sulfuric acid bath having a concentration of 200 g/L, and then by a direct-current electrolysis method with a current density of 32 $A/dm^2$ in a sulfuric acid bath having a concentration of 25 g/L. The film thickness was non-uniform in the single-layer coating formed by the direct-current electrolysis method alone, whereas a uniform film thickness was obtained in the case in which a coating was formed by the AC-DC superimposition electrolysis method in advance, and then another coating was fabricated by the direct-current electrolysis method. In addition, the porosity of the coating formed by the direct-current electrolysis method in the test piece was 25% or higher, in contrast to about 15% obtainable by using an ordinary sulfuric acid bath. The reason for the uniform film thickness was that the coating formed by the AC-DC superimposition electrolysis method and having a certain film thickness prevented the local concentration of current, so that a voltage of 40 to 50 V, which was high for a sulfuric acid bath, was applied without causing burning of the coating. As described above, it has been found that a high voltage of 40 V or higher can be applied stably from the beginning to the end in the case of a coating having the two-layer structure.

INDUSTRIAL APPLICABILITY

The anodizing treatment method and the structure of an internal combustion engine according to the present invention make it possible to obtain an aluminum-based material provided with both high heat insulation properties and a high corrosion resistance, a high durability and a high impact resistance, high water-repellent and oil-repellent functions, and further a good coating formation efficiency.

REFERENCE SIGNS LIST

1: aluminum-based material; 2: anodic oxide coating; 2*a*: first anodic oxide coating (anodic oxide layer formed by direct-current electrolysis); 2*b*: second anodic oxide coating (anodic oxide layer formed by AC-DC superimposition electrolysis); 5: silicon; 10: anodizing treatment apparatus; 11: electrolytic tank; 12: anode; 13: a pair of cathodes; 14: lead wire; 15: power source

The invention claimed is:

1. A structure of an internal combustion engine, comprising at least:

a first anodic oxide coating on a surface of an aluminum-based material constituting a combustion chamber in an internal combustion engine; and a second anodic oxide coating on a surface of the first anodic oxide coating, wherein the first anodic oxide coating has more pores therein than the second anodic oxide coating, and a film thickness of the first anodic oxide coating is greater than a film thickness of the second anodic oxide coating, wherein the film thickness of the second anodic oxide coating is 10 μm to 100 μm, and a total film thickness of the first anodic oxide coating and the second anodic oxide coating is greater than or equal to 50 μm, and wherein the second anodic oxide coating has a random orientation by AC-DC superimposition electrolysis.

2. The structure of an internal combustion engine according to claim 1, wherein the first anodic oxide coating has a porosity of 25% to 75%.

3. The structure of an internal combustion engine according to claim 1, wherein the total film thickness of the first anodic oxide coating and the second anodic oxide coating is 50 μm to 500 μm.

4. The structure of an internal combustion engine according claim 1, wherein the first anodic oxide coating is obtained by application of direct-current electrolysis, and the second anodic oxide coating is obtained by application of AC-DC superimposition electrolysis.

5. The structure of an internal combustion engine according to claim 1, wherein silicon and nano-level pores derived from the silicon are present in the first anodic coating.

* * * * *